US007156243B2

(12) United States Patent
Henning et al.

(10) Patent No.: US 7,156,243 B2
(45) **Date of Patent: *Jan. 2, 2007**

(54) PERFORATED DECKING

(75) Inventors: John T. Henning, Virginia Beach, VA (US); David J. Cross, Guanajuato (MX); Bert Y. Culpepper, Jr., Chesapeake, VA (US); Timothy G. Kircher, N. Longbranch, NJ (US)

(73) Assignee: Design Assistance Construction Systems, Inc., Portsmouth, VA (US)

( * ) Notice: Subject to any disclaimer, the term of this patent is extended or adjusted under 35 U.S.C. 154(b) by 377 days.

This patent is subject to a terminal disclaimer.

(21) Appl. No.: 10/403,665

(22) Filed: Nov. 8, 2002
(Under 37 CFR 1.47)

(65) Prior Publication Data

US 2005/0150852 A1 Jul. 14, 2005

Related U.S. Application Data

(63) Continuation of application No. 10/120,794, filed on Apr. 12, 2002, now abandoned, which is a continuation-in-part of application No. 09/613,699, filed on Jul. 11, 2000, now Pat. No. 6,401,944.

(51) Int. Cl.
*A47F 5/08* (2006.01)

(52) U.S. Cl. ..... 211/153; 52/450; 211/183

(58) Field of Classification Search ..... 211/153, 211/183; 108/51.3, 53.1, 51.11, 901, 902; 52/630, 450, 220.4, 180, 336; 428/182, 132
See application file for complete search history.

(56) References Cited

U.S. PATENT DOCUMENTS

| | | | | |
|---|---|---|---|---|
| 1,073,151 | A | 9/1913 | Matthew | |
| 2,381,608 | A * | 8/1945 | Leyerle | 34/238 |
| 2,606,806 | A * | 8/1952 | Giffard | 312/350 |
| 3,812,636 | A * | 5/1974 | Albrecht et al. | 52/334 |
| 3,856,344 | A | 12/1974 | Loeber | |
| 3,886,702 | A * | 6/1975 | Fork | 174/49 |
| 4,630,414 | A | 12/1986 | Ting | |
| 5,440,998 | A | 8/1995 | Morgan, IV et al. | |
| 5,454,128 | A * | 10/1995 | Kwon | 14/73 |
| 6,065,266 | A * | 5/2000 | Behr et al. | 52/630 |
| 6,079,339 | A * | 6/2000 | Houk et al. | 108/186 |
| 6,401,944 | B1 * | 6/2002 | Kircher et al. | 211/134 |
| 6,408,586 | B1 * | 6/2002 | Deckert | 52/630 |

* cited by examiner

*Primary Examiner*—Jennifer E. Novosad
(74) *Attorney, Agent, or Firm*—Hunton & Williams

(57) ABSTRACT

A corrugated decking is provided that has a plurality of top horizontal surfaces, a plurality of bottom surfaces, and a plurality of transition surfaces, each transition surface connecting one of the top horizontal surfaces to one of the bottom surfaces. One of the top horizontal surfaces has a plurality of apertures, the apertures having downwardly sloping flanges surrounding each aperture.

26 Claims, 8 Drawing Sheets

PERFORATED DECKING

This is a continuation of U.S. Application No. 10/120,794, filed Apr. 12, 2002, abandoned, which is a continuation-in-part of U.S. Application No. 09/613,699, filed Jul. 11, 2000, now U.S. Pat. No. 6,401.244, each of which is incorporated herein by reference in its entirety.

FIELD OF THE INVENTION

The invention relates to perforated decking. More particularly, embodiments of the invention relate to decking used primarily in industrial and commercial racks and walkways.

BACKGROUND OF THE INVENTION

Decking or shelving used in industrial and commercial storage racks has to be designed and constructed to bear heavy loads without twisting or buckling. For example, shelving used in bulk storage applications must be able to support the weight of densely packed rows of boxes filled with goods. In such applications, a solid steel sheet deck is a good choice for shelving because it has a high load-bearing capacity.

The design and construction of decking or shelving must comply, however, with the requirements of any fire codes applicable to the particular storage environment. Fire codes generally require that the surface area of each deck or shelf have a certain amount of open area, e.g., a number of holes distributed along the surface of the deck or shelf. A solid steel sheet deck would not meet this "open area" requirement and therefore could not be used as storage rack shelving or walkway decking.

The "open area" requirement serves two primary objectives from the standpoint of fire safety and prevention. First, the open area of each deck or shelf allows a fire that has broken out to move vertically up the storage rack instead of spreading horizontally to other storage racks, as the fire would do if it had broken out beneath a solid steel sheet deck. It also allows heat generated by the fire to dissipate instead of building up within a semi-enclosed space, as would be the case in a storage space between two solid steel sheet decks. In short, the open area creates a flue space within a storage rack, thereby causing the fire to travel upward and to release heat in the process. This maximizes the effectiveness of the sprinkler system in containing the fire because it allows the fire to reach the sprinkler heads as quickly as possible without building up too much heat and intensity.

Second, the open area of each deck or shelf allows water from an overhead sprinkler system to flow downward in the event of a fire. As long as water runs freely through the individual decks or shelves, an overhead sprinkler system can adequately contain a fire breaking out at any shelving level and prevent it from spreading to other storage racks.

The amount of open area generally required by fire codes is fifty percent (50%) of the surface area. Lower percentages may be allowed, however, depending on the particular storage environment. As pointed out above, a solid steel sheet deck does not have any open area and therefore would not meet this "fifty-percent" rule. Consequently, it could not be used in bulk storage applications even though it has a high load-bearing capacity.

SUMMARY OF THE INVENTION

Embodiments of the invention include a corrugated decking having a plurality of top horizontal surfaces, a plurality of bottom surfaces, and a plurality of transition surfaces, each transition surface connecting one of the top horizontal surfaces to one of the bottom surfaces. One of the top horizontal surfaces has a plurality of apertures, the apertures having downwardly sloping flanges surrounding each aperture.

Other embodiments of the invention include a corrugated decking having a plurality of top horizontal surfaces, and a plurality of transition surfaces, each transition surface connecting one of the top horizontal surfaces to another one of the transition surfaces. One of the top horizontal surfaces has a plurality of apertures, the apertures having downwardly sloping flanges surrounding each aperture.

BRIEF DESCRIPTION OF THE DRAWINGS

This invention is described with reference to the following drawing figures, where like reference numbers represent like features.

DETAILED DESCRIPTION OF THE PREFERRED EMBODIMENTS

Figure 1:
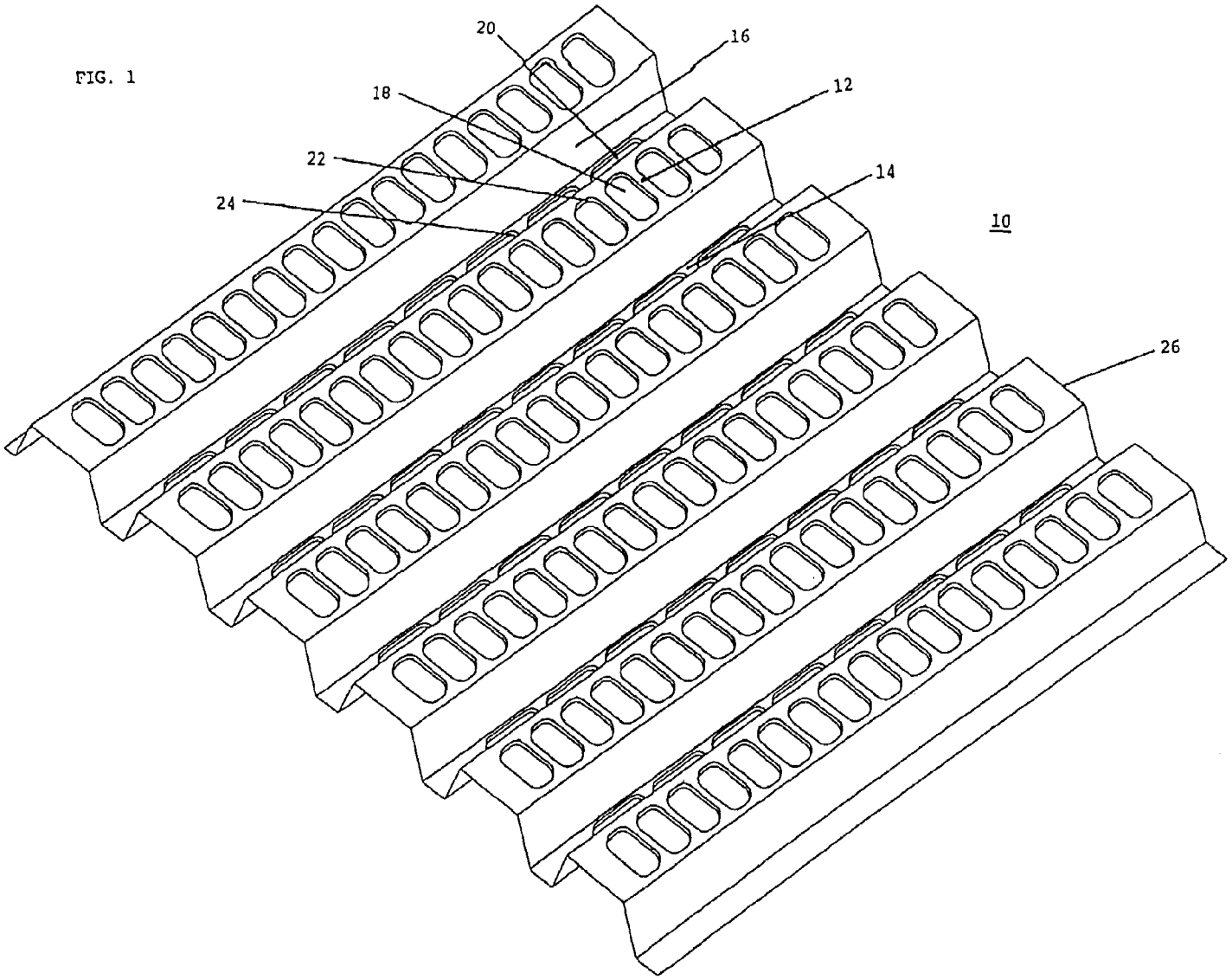
FIG. 1 is a perspective view of a section of a corrugated deck in accordance with the invention.

The fifty-percent rule necessarily calls for a unique solution to the problem of providing structural strength to decking or shelving. Solutions currently available in the industry are simply inadequate.

For example, a wire mesh deck, commonly used in industrial and commercial settings, meets the fifty-percent rule but it deforms relatively easily under heavy loads because it has no uniform loading support. When it deforms, the deck no longer has a flat surface on which to rest boxes. It is difficult enough, even with a flat surface, to load boxes onto a wire mesh deck and to move them from side to side once they are on the deck. The loss of a flat surface further aggravates this problem.

Moreover, a wire mesh deck tends to rip up bulk items, thereby damaging stored goods. Cardboard boxes, carpets, and upholstered goods are susceptible to damage from punctures and snags as they are loaded onto or off a wire mesh deck. A wire mesh deck also creates a safety risk because the wire ends along the so-called "waterfall" edge that hugs the support beam can bend up and cut a worker's stray finger or other body part.

Wire mesh decks require long lead times for production. They cannot be packed densely in shipping, and therefore the costs of shipping are higher than they otherwise could be.

A slatted wooden deck, also commonly used, has disadvantages of its own. Wood burns and smokes readily. It also warps and moves due to moisture and has to be replaced more often than steel. Also, wooden decks are not as strong as steel decks, and the individual slats may break, thereby causing a failure in the structural integrity of the deck and a safety hazard for workers.

Another bulk storage solution is a roll formed "front to back bar." This solution consists of a roll formed C-channel with welded end plates that attach to a step beam. This solution is very expensive from a manufacturing standpoint because it uses a lot of heavy gauge steel. Moreover, one still has to use wooden pallets because the solution itself does not provide a flat storage surface.

Recognizing the disadvantages inherent in wire mesh decks and slatted wooden decks, and the need for decking or shelving that meets fire code requirements without sacrificing load-bearing capacity, others besides the present inventors have experimented with alternative designs and constructions. Consider the following examples.

U.S. Pat. No. 5,199,582 to Halstrick discloses storage rack shelving in which there are corrugated decks with channels below the top surface for guiding and confining sprinkler fluid. Evenly spaced along the channels are openings through which sprinkler fluid flows down to the next shelving level. The decks, however, each have an open area of less than one-half of 1% of the total deck area. This does not meet the fifty-percent rule.

Indeed, Halstrick's invention expressly teaches away from the use of open decking. The disclosure of U.S. Pat. No. 5,199,582 considers open decking to be undesirable because it allows hot air to flow upward and cause a chimney effect. The disclosure points out that Halstrick's invention does not permit smoke and gas to flow upwardly. Contrary to this disclosure and as explained above, open decking actually works together with an overhead sprinkler system to contain a fire. When a fire breaks out in a storage environment, the fire's natural tendency is to rise, seeking out additional oxygen. Smoke and hot air also rise. They thus find their way to the closest sprinkler head, which activates and releases a spray of water. The water falls downward, thereby containing the fire and protecting areas adjacent to where the fire started. The open decking also allows excess heat to dissipate more rapidly. This is important because a hotter fire will be more difficult for the sprinkler system to contain, because the water droplets vaporize before they make contact with the flames.

U.S. Pat. No. 3,986,462 to Heft discloses shelving units with circular holes uniformly spaced throughout the surface area to permit the passage of water. Each shelving unit derives its structural strength through the presence of side members depending from the longitudinal edges of the top portion. Each shelf in turn is made up of several shelving units placed side by side on the beams of the rack. One apparent disadvantage with this design is the fact that the shelving units must be precisely sized so that they interlock snugly with the rack beams. Another disadvantage of Heft's invention is that the units would be prohibitively expensive to manufacture because of the high cost of materials. The units would also be costly to ship and install. Additionally, the circular holes in the shelving units weaken the structure such that the design cannot bear heavy loads. The holes also turn the shelving units into cheese graters that can damage stored goods and injure people.

U.S. Pat. No. 3,927,769 to Maslow et al. discloses a shelf made of a rectangular sheet of material having raised ribs to support items placed thereon and apertures to permit the flow of air or water. The ribs reinforce the shelf structure. Based on the drawings accompanying this patent, however, it does not appear that this design would meet the fifty-percent rule generally required by fire codes today.

Bar grating is currently used in warehouse flooring applications to provide a flooring surface for mezzanines, aisle ways, safety flooring and other flooring that requires a 50% open area to conform to fire codes. However, bar grating is costly and time consuming to produce and install.

Despite alternative designs and constructions that have been proposed over the years, as exemplified by the above patents, wire mesh decks and slotted wooden decks are still widely used in industrial and commercial storage racks and bar grating is still widely used in floor decking applications. There have been few attempts to address the needs of industry for decking and shelving that meets the fifty-percent rule and yet provides the load-bearing capacity required in bulk storage and flooring applications. Such decking or shelving should also be nonflammable and suitable for mass production and shipping at minimal cost.

The invention fulfills all of the above objectives. It offers a simple and elegant solution to industry requirements of shelving having a large percentage, for example, fifty-percent, of open area and a structure designed to withstand maximum stress with minimum amount of deflection. This invention provides a smooth flat surface for storage of bulk items. Moreover, in the preferred embodiments, this solution can be readily implemented with minimal retooling of existing machines for fabricating metals and manufactured and shipped at competitive prices.

Figure 2:
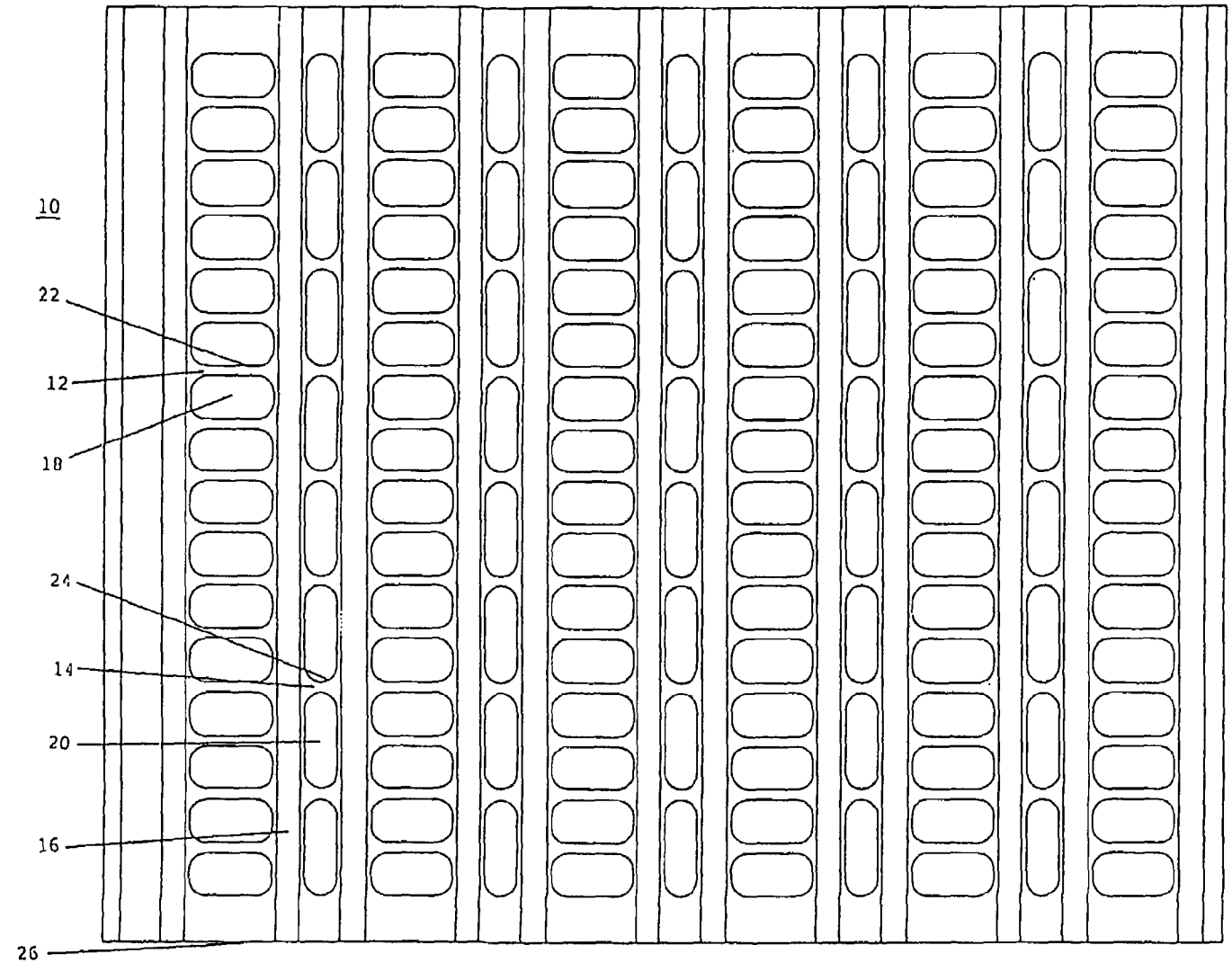
FIG. 2 is a top plan view of the corrugated deck shown in FIG. 1.
Figure 3:
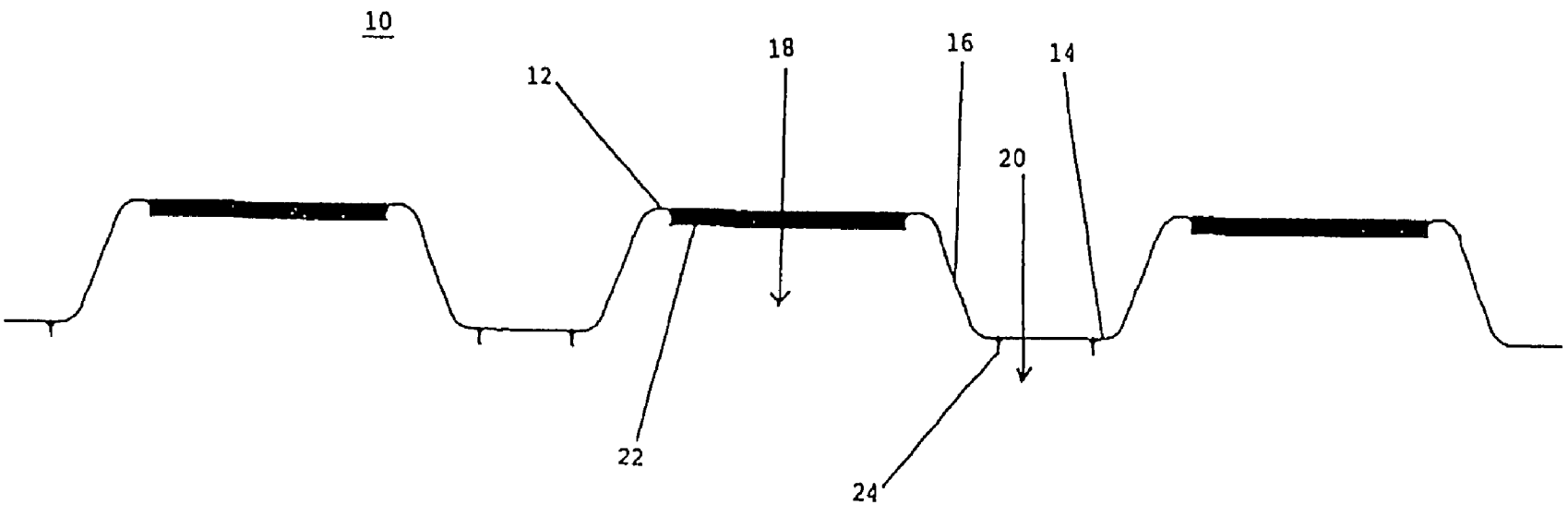
FIG. 3 is a cutaway, cross-sectional view of a strip of corrugated deck in accordance with the invention.

FIGS. 1, 2 and 3 illustrate features of an example of a corrugated deck in accordance with the invention. As seen in FIGS. 1 and 2, a corrugated deck 10 has top horizontal surfaces 12, bottom surfaces 14, and transition surfaces 16. Punched or formed into the top horizontal surfaces 12 and/or the bottom surfaces 14 are a plurality of apertures 18 and 20. Surrounding the apertures 18 and 20 are vertical flanges 22 and 24, respectively. Also seen in FIGS. 1 and 2 is a portion of a terminal edge 26 of the corrugated deck.

In FIG. 3, a strip of the corrugated deck shown in FIGS. 1 and 2 has been cut away to show the cross-sectional geometry of the vertical flanges 22 and 24 surrounding the apertures 18 and 20. As one can see, the material of the top horizontal surface 12 surrounding the aperture 18 slopes downward, forming the vertical flange 22. The material of the bottom surface 14 surrounding the aperture 20 likewise slopes downward, forming a vertical flange 24.

In the embodiment of FIGS. 1 and 2, the deck is manufactured, for example, from sheets of galvanized steel commonly used for roofs. The apertures 18 and 20 are punched into the metal and the surrounding metal is drawn downward to form the vertical flanges 22 and 24.

The manufacture of corrugated decks in accordance with the invention can involve the following process. First, the metal sheets are roll formed into decks and cut to length to a tight tolerance. After the sheets have been formed into decks and cut to length, they are sent through the punching operation. This operation consists of feeding the sheets through a punch press that is equipped with specialized tooling. The punch press first punches the holes into the flat surfaces of the sheets, and then draws the metal surrounding the holes downward to form the vertical flanges, as indicated above.

The punch press works by indexing the sheets. The press will make a first set of holes in a sheet and then index the sheet forward. The press will then make another set of holes in the same sheet and at the same time draw the metal surrounding the holes that were made in the previous operation cycle into vertical flanges. The press finishes a deck by making the last set of flanges and pushing the sheet out to be stacked for shipping. This operation can be run with different degrees of automation depending on demand for the product.

Figure 4:
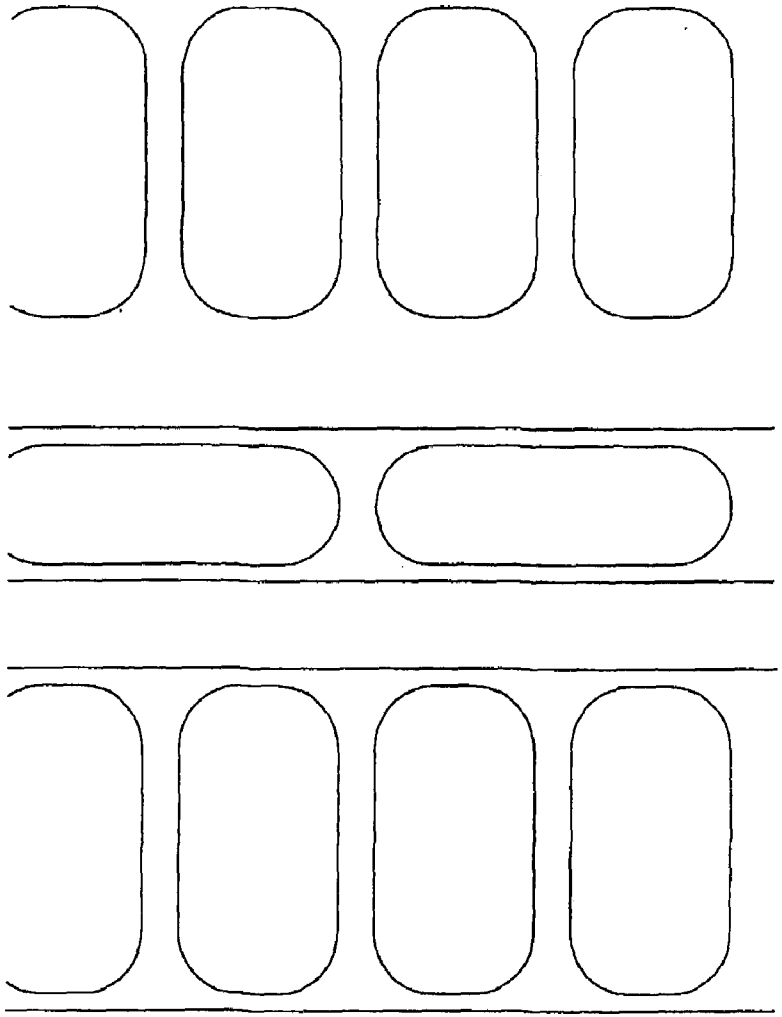
FIG. 4 is a pattern used to create the corrugated deck shown in FIGS. 1 and 2.

FIG. 4 shows the pattern used to create the corrugated deck shown in FIGS. 1 and 2. The size and shape of the apertures, and their frequency on the top and bottom surfaces, may vary depending upon the percentage of open area required by the applicable fire code, and the specific requirements of the user (e.g., required load-bearing capacity). For example, if the deck needs to have only twenty-percent open area, then the top and bottom surfaces could have fewer apertures per row, or smaller apertures. Accordingly, the number of predetermined patterns created for corrugated decks of this invention are practically limitless, constrained only by fire code and user requirements and/or preferences.

Figure 5:
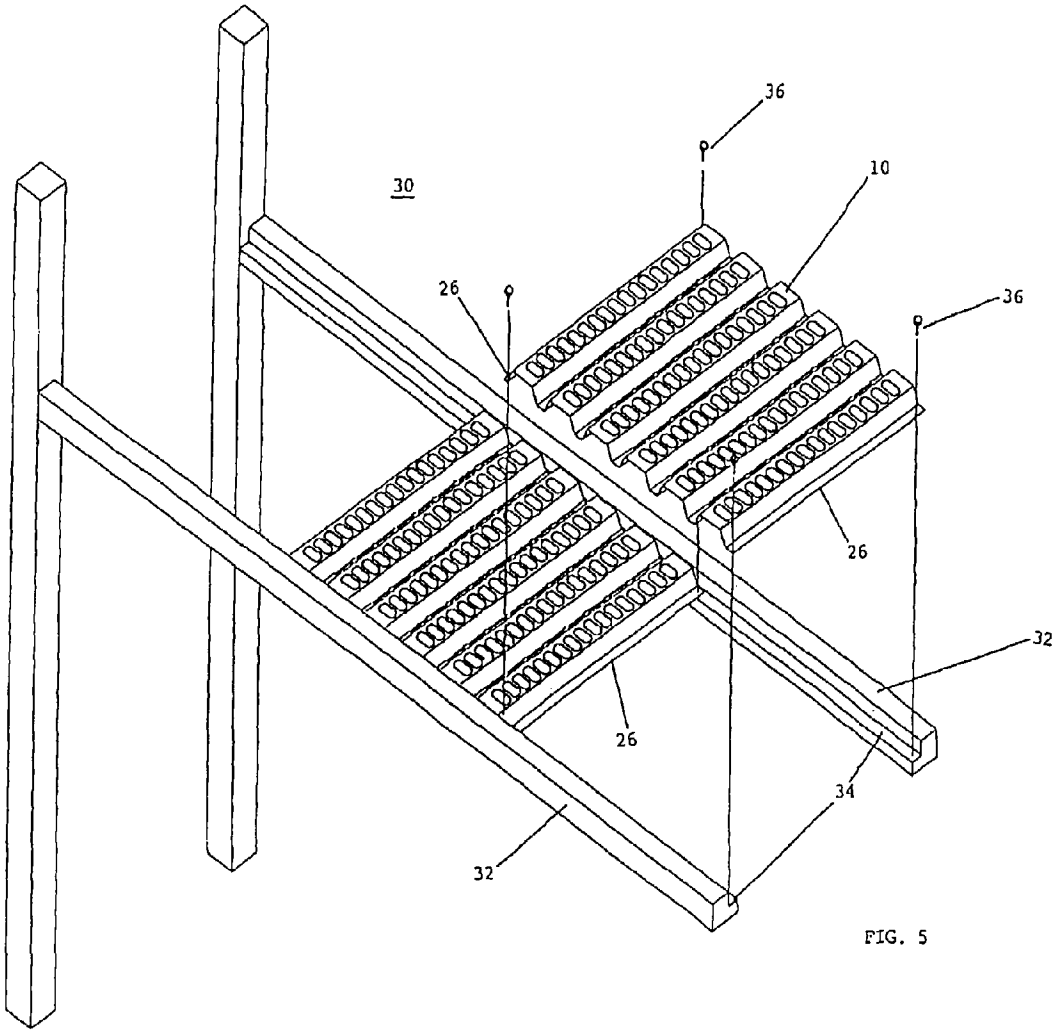
FIG. 5 is a environmental view of a corrugated deck in accordance with the invention, as used in a storage rack.

FIG. 5 depicts a corrugated deck 10 in accordance with the invention as part of a storage rack 30. Each deck 10 is inserted between two L-shaped support beams 32 and rests on the ledges 34 of the support beams. The decks are fastened to the support beams with bolts 36. Note that a terminal edge 26 of one deck overlaps with a terminal edge 26 of an adjacent deck when the decks are properly positioned on and fastened to the support beams 32.

Although some embodiments of the invention are corrugated decks made of sheet steel, other materials such as plastic and fiberglass would also be suitable. For example, if the deck is made from a durable plastic, the apertures 18 and 20 and the vertical flanges 22 and 24 could be formed by extruding the plastic into a mold or cast of the predetermined pattern.

The cross-sectional geometry of the vertical flanges 22 and 24 depicted in FIG. 3 can vary. The embodiment shown in FIGS. 1 and 2 was modeled with a computer to ensure that the resulting structures would pass standard tests for stress and deflection. Preferred embodiment and other designs have undergone tests (1) to determine the amount and distribution of stress and the degree of deflection in typical load-bearing situations, and (2) to calculate the rate of flow of liquid through the apertures. The first set of tests have confirmed the validity of the designs from the standpoint of achieving uniform load-bearing capacity. The second set of tests have demonstrated that the rate of flow of water through the apertures greatly exceeds the maximum rate of water discharged by sprinkler systems used in industrial and commercial settings.

Figure 6:
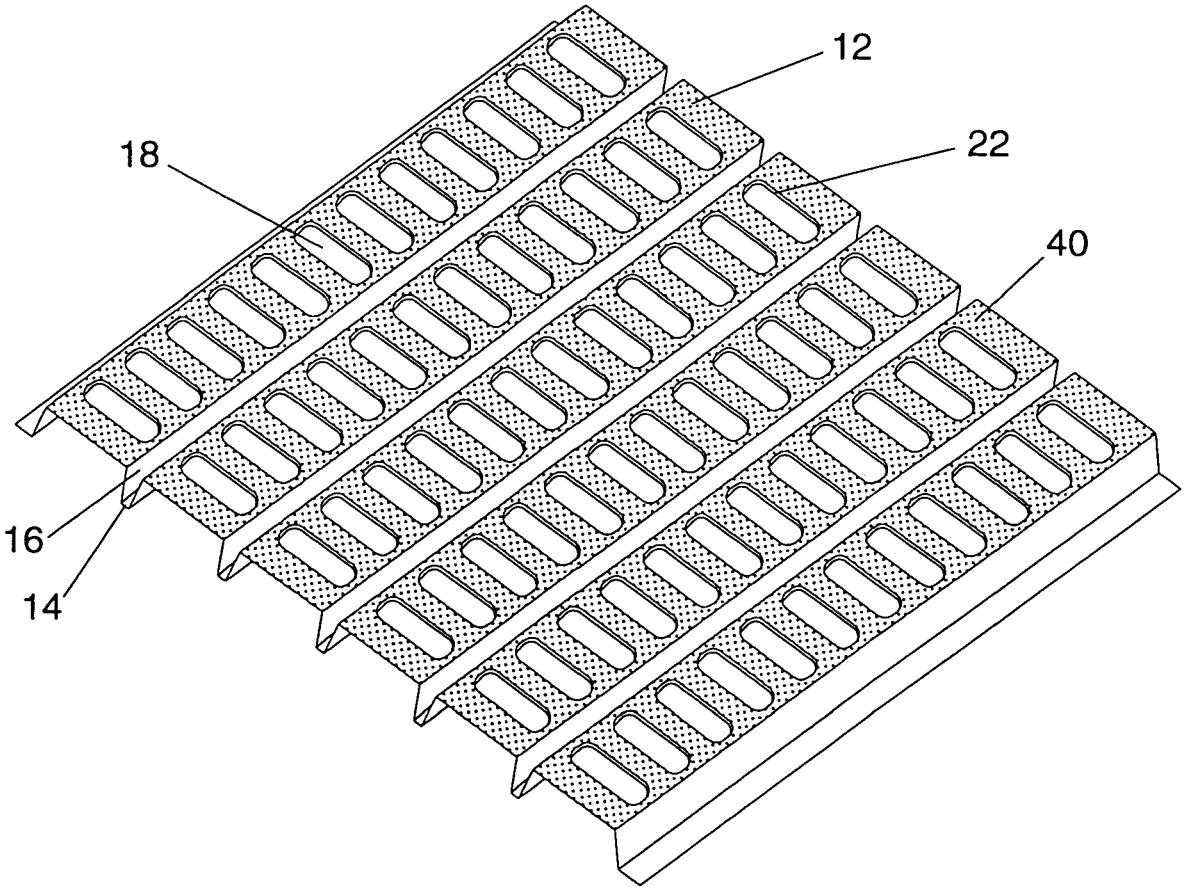
FIG. 6 is a perspective view of a section of an example of a corrugated deck in accordance with the invention.

FIG. 6 shows an example of perforated decking in accordance with an embodiment of the invention particularly suited for floor decking. It is preferred in floor decking applications that the distance between adjacent top horizontal surfaces 12 be small to help minimize adverse affects, such as tripping, on people walking on the floor decking. In the example shown in FIG. 6, the top horizontal surfaces 12 are substantially wider than the bottom surfaces 14 to provide a more stable walking surface for the user. In addition, some embodiments include a surface treatment 40 to produce a non-skid surface. Examples of surface treatment 40 include, but are not limited to, applied non-skid treatments and protrusions embossed in the surface of the decking material itself. The surface protrusions can be embossed in a predetermined pattern or randomly.

Figure 7:
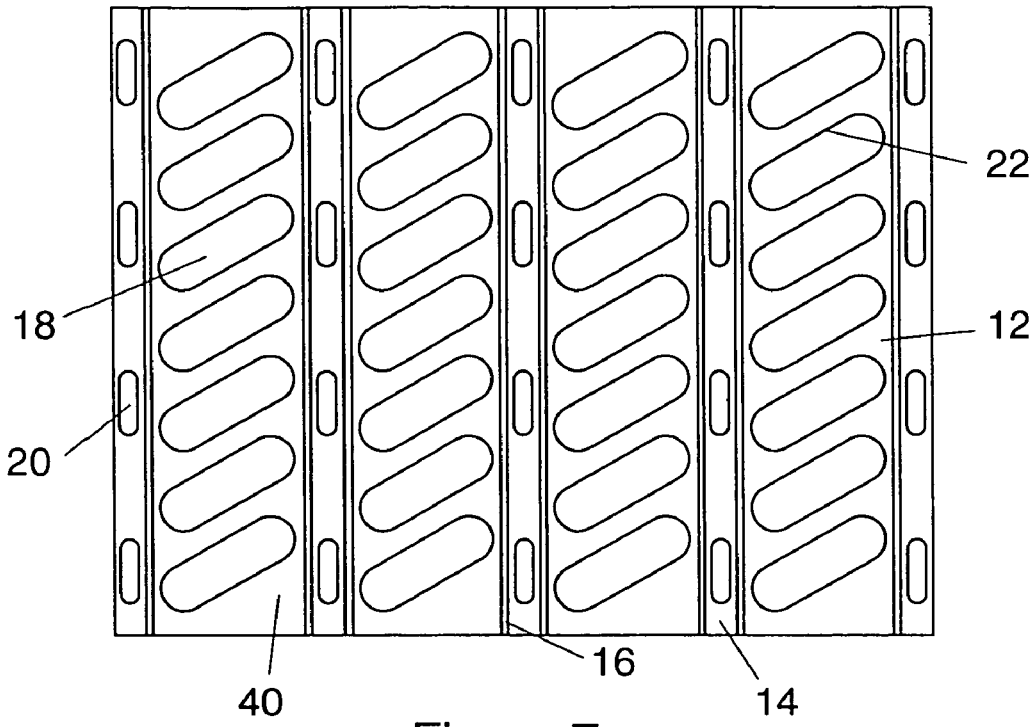
FIG. 7 is a plan view of an example of an embodiment of the invention.

FIG. 7 is a plan view of an embodiment of the invention having apertures 18 in top horizontal surfaces 12 and apertures 20 in bottom surfaces 14. In preferred embodiments, apertures 18 have vertical flanges 22 and apertures 20 have similar vertical flanges. As can be seen from FIG. 7, transition surfaces 16 connect top horizontal surfaces 12 to bottom surfaces 14 at an angle greater than 90 degrees. In preferred embodiments, this angle is between 90 degrees and 120 degrees, more preferably between 90 degrees and 110 degrees. This angle is determined based on load bearing requirements and deck stackability, which is an important consideration with regard to shipping costs.

Figure 8:
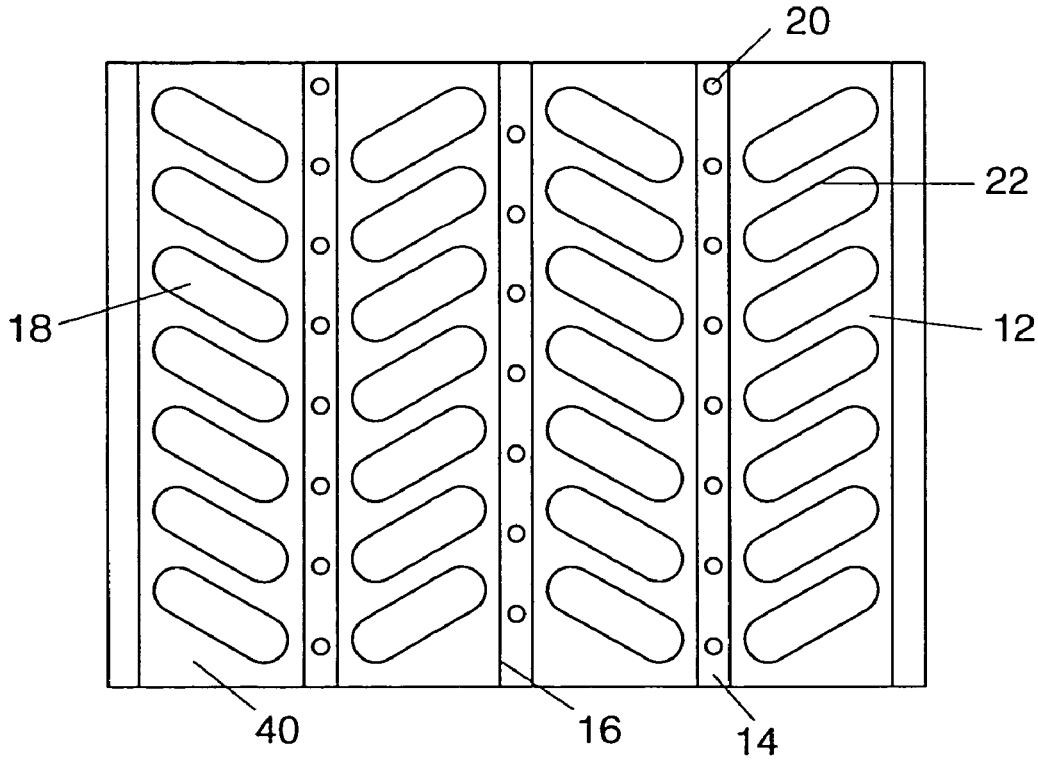
FIG. 8 is a plan view of example of another embodiment of the invention.

FIG. 8 shows a plan view of another embodiment of the invention. In this embodiment, the pattern of apertures 18 is not the same for every top horizontal surface 12. While rounded rectangles are shown as an example of an appropriate shape for apertures 18 it is noted that apertures 18 can be any shape that provides sufficient open surface area and sufficient load bearing capacity. Similarly, while apertures 20 are shown as circles, it is noted that apertures 20 can be any appropriate shape or size. Unlike FIG. 7, FIG. 8 shows transition surfaces 16 as being 90 degrees relative to top horizontal surfaces 12 and bottom surfaces 14. While this embodiment may not provide efficient stacking of decking sheets, it may be desirable for higher load bearing applications.

Figure 9:
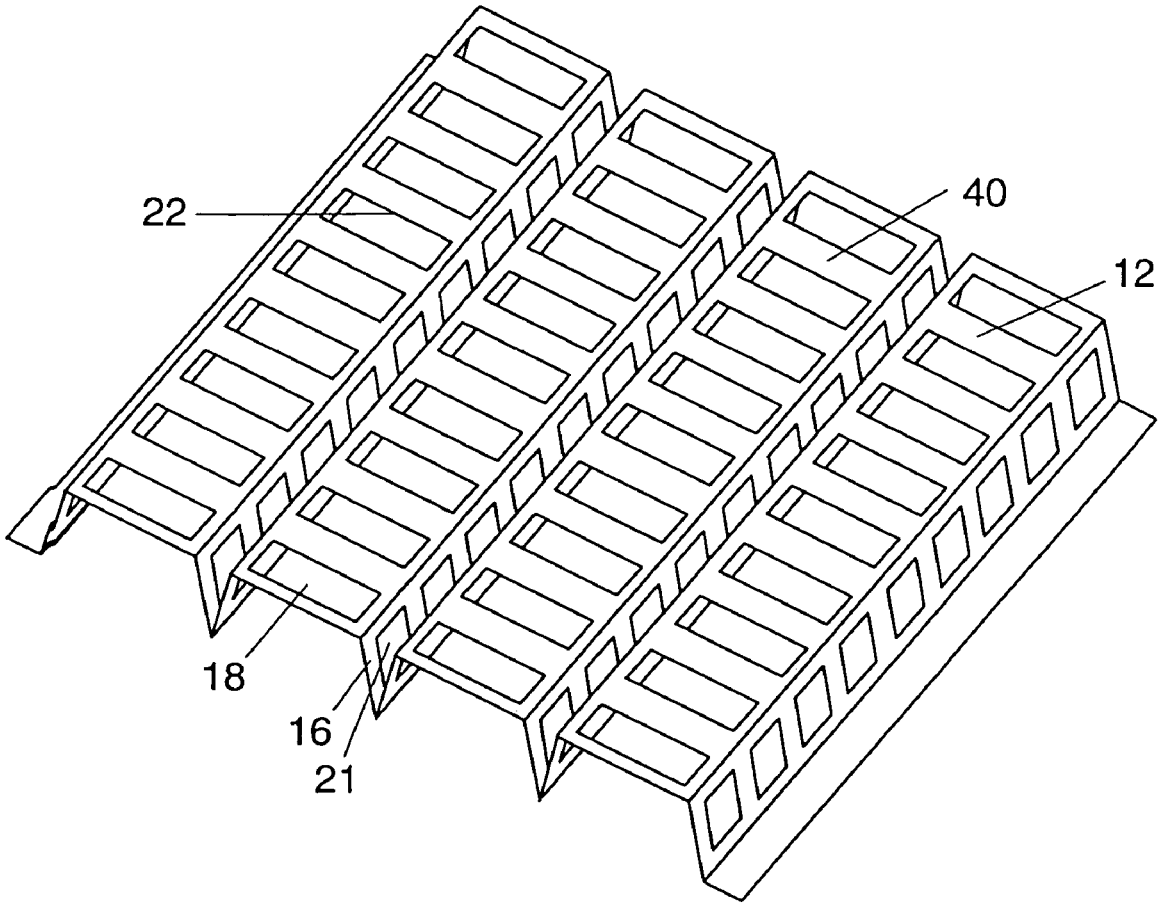
FIG. 9 is a perspective view of an example of an embodiment of the invention.

FIG. 9 shows an embodiment of the invention having top horizontal surfaces 12 and transition surfaces 16, but no bottom surfaces 14. In this example, transition surfaces 16 are provided with apertures 21. In preferred embodiments, apertures 21 are provided with vertical flanges similar to vertical flanges 22 of apertures 18 in top horizontal surfaces 12. It is again noted that the shape and size of apertures 18 and apertures 21 are only one example of the possible sizes and shapes that can be used.

The corrugated decks of this invention have been shown to be less costly to manufacture than wire mesh decks and bar grating. They are also more durable than wire mesh and easier to install than bar grating. Whereas bar grating is usually attached using many clips, decking in accordance with the invention can simply be screwed to underlying support structure.

Although this invention has been described and illustrated in connection with certain preferred embodiments, it is to be understood that modifications and variations may be made to it without departing from the spirit of the invention, as those skilled in this art will readily understand. Such modifications and variations are considered to be within the purview and scope of this invention.

We claim:

1. A corrugated decking, comprising:

a plurality of top horizontal surfaces;

a plurality of bottom surfaces; and a plurality of transition surfaces, each transition surface connecting one of the top horizontal surfaces to one of the bottom surfaces, wherein at least one of the top horizontal surfaces has a plurality of first apertures, the first apertures each having a downwardly sloping flange;

wherein at least one of the bottom surfaces has a plurality of second apertures;

and wherein the corrugated decking has an open area comprising at least fifty percent of a total area in plan view of the corrugated decking, the open area being formed at least by the first apertures and the second apertures.

2. The decking of claim 1, wherein the second apertures each have a downwardly sloping flange.

3. The decking of claim 1, wherein the bottom surfaces are horizontal.

4. The decking of claim 1, wherein the transition surfaces are substantially vertical.

5. The decking of claim 1, wherein the transition surfaces are at an angle of between 90 and 120 degrees relative to the top horizontal surfaces.

6. The decking of claim 5, wherein the transition surfaces are at an angle of between 90 and 110 degrees relative to the top horizontal surfaces.

7. The decking of claim 1, wherein the transition surfaces are at an angle relative to the top horizontal surfaces such chat two identical pieces of the decking are stackable with each other and, when stacked, the bottom surfaces of an upper one of the two pieces of decking are below a level of the cop horizontal surfaces of a lower one of the two pieces of decking.

8. The decking of claim 1, wherein a width of a first one of the top horizontal surfaces is defined as a distance in a transverse direction between a first point where a first one of the transition surfaces contacts the first cop horizontal surface and a second point where a second one of the transition surfaces contacts the first top horizontal surface, a width of a first valley is defined as a distance in the transverse direction between the second point and a third point where a third one of the transition surfaces contacts a second one of the top horizontal surfaces, the second top horizontal surface being adjacent the first top horizontal surface, and the width of the first top horizontal surface is greater than the width of the first valley.

9. The decking of claim 8, wherein the width of the first top horizontal surface is at least twice the width of the first valley.

10. The decking of claim 8, wherein the width of the first valley is less than one inch.

11. The decking of claim 1, wherein at least one of the top horizontal surfaces has non-skid surface.

12. The decking of claim 11, wherein the non-skid surface comprises a plurality of shapes embossed in the top horizontal surfaces.

13. The decking of claim 12, wherein the plurality of shapes embossed in the top horizontal surfaces form a predetermined pattern.

14. The decking of claim 1, wherein the apertures are arranged in a predetermined pattern.

15. The decking of claim 14, wherein the apertures on a first top horizontal surface are arranged in a first predetermined pattern, the apertures on a second top horizontal surface are arranged in a second predetermined pattern and the First predetermined pattern is different than the second predetermined pattern.

16. The decking of claim 1, wherein at least one of the transition surfaces has a plurality of third apertures, each third aperture having a downwardly sloping flange.

17. The decking of claim 1, wherein a width of a first one of the top horizontal surfaces is defined as a distance in a transverse direction between a first point where a first one of the transition surfaces contacts the first top horizontal surface and a second point where a second one of the transition surfaces contacts the first top horizontal surface, a width of a first valley is defined as a distance in the transverse direction between the second point and a third point where a third one of the transition surfaces contacts a second one of the top horizontal surfaces, the second top horizontal surface being adjacent the first top horizontal surface, the width of the first top horizontal surface is greater than the width of the first valley, the transition surfaces are at an angle relative to the top horizontal surfaces such that two identical pieces of the decking are stackable with each other and, when stacked, the bottom surfaces of an upper one of the two pieces of decking are below a level of the top horizontal surfaces of a lower one of the two pieces of decking, and at least one of the top horizontal surfaces has a non-skid surface, the non-skid surface comprising a plurality of shapes embossed in the top horizontal surfaces.

18. A storage rack having as shelving the decking of claim 17.

19. A floor deck having as decking the decking of claim 17.

20. A storage rack having as shelving the decking of claim 1.

21. A floor deck having as decking the decking of claim 1.

22. A corrugated decking, comprising:

a plurality of top horizontal surfaces;

a plurality of bottom surfaces;

a plurality of transition surfaces, each transition surface connecting one of the top horizontal surfaces to one of the bottom surfaces;

wherein at least one of the top horizontal surfaces has a plurality of first apertures, the first apertures each having a downwardly sloping flange;

wherein the corrugated decking has an open area comprising at least fifty percent of a total area in plan view of the corrugated decking, the open area being formed at least by the first apertures; and wherein the transition surfaces are at an angle relative to the top horizontal surfaces and bottom surfaces such that two identical pieces of the corrugated decking are stackable with each other and, when stacked, the bottom surfaces of an upper one of the two pieces of decking are below a level of the top horizontal surfaces of a lower one of the two pieces of decking.

23. The decking of claim 22, wherein at least one of the bottom surfaces has a plurality of second apertures.

24. The decking of claim 23, wherein the second apertures each have a downwardly sloping flange.

25. The decking of claim 22, wherein the bottom surfaces are horizontal.

26. The decking of claim 22, wherein a width of a first one of the top horizontal surfaces is defined as a distance in a transverse direction between a first point where a first one of the transition surfaces contacts the first top horizontal surface and a second point where a second one of the transition surfaces contacts the first top horizontal surface, a width of a first valley is defined as a distance in the transverse direction between the second point and a third point where a third one of the transition surfaces contacts a second one of the top horizontal surfaces, the second top horizontal surface being adjacent the first top horizontal surface, and the width of the first top horizontal surface is greater than the width of the first valley.

* * * * *